United States Patent [19]

Farkas

[11] 4,133,267

[45] Jan. 9, 1979

[54] TRAVEL DRIVE FOR A DRAWING ENGINE OF A ONE-RAIL TRACK SUSPENSION RAILROAD IN MINES

[76] Inventor: Laszlo Farkas, Am Hang 31, 4713 Bockum-Hövel, Fed. Rep. of Germany

[21] Appl. No.: 817,105

[22] Filed: Jul. 19, 1977

[30] Foreign Application Priority Data

Jul. 20, 1976 [DE] Fed. Rep. of Germany ..... 2632506

[51] Int. Cl.[2] ..... B61C 11/00

[52] U.S. Cl. ..... 105/29 R; 104/163; 104/165

[58] Field of Search ..... 104/165, 148, 150, 163; 105/148, 150, 29 R, 30

[56] References Cited

FOREIGN PATENT DOCUMENTS 313784 4/1916 Fed. Rep. of Germany ..... 105/29 R
451741 10/1927 Fed. Rep. of Germany ..... 105/29 R
1430992 3/1969 Fed. Rep. of Germany ..... 105/30
2453751 5/1976 Fed. Rep. of Germany ..... 105/30
146289 12/1881 France ..... 105/29 R

*Primary Examiner*—Lawrence J. Oresky
*Attorney, Agent, or Firm*—Michael J. Striker

[57] ABSTRACT

A travel drive for a pulling engine of a single rail suspended railroad used in mines includes a pair of friction wheels and a pair of toothed wheels each of which is mounted on a common shaft with the respective friction wheels for joint rotation therewith about a vertical axis and for displacement along the common shaft between a retracted position in which the toothed wheel is accommodated in a protective chamber of the respective friction wheel, and a raised position in which the toothed wheel is capable of engaging an indented segment extending along the rail. A double-action cylinder-and-piston arrangement is so operatively connected to the respective toothed wheel as to be capable of raising and lowering the same.

4 Claims, 6 Drawing Figures

TRAVEL DRIVE FOR A DRAWING ENGINE OF A ONE-RAIL TRACK SUSPENSION RAILROAD IN MINES

This invention relates to a travel drive for drawing engines in a one-rail track suspension railroad in mines, where the gearing casing is provided in its interior with, and has located on either side of the rail, a driving friction wheel and a driving toothed wheel; the driving friction wheels are laid horizontally against the stem of the suspended rail and may be compressed against the same, while the driving toothed wheels are arranged coaxially with these driving friction wheels and are limitedly raisable and retractable by means of a lifting arrangement provided on the axis and are engageable in their raised positions only with, and apt to slide into lateral indentations on, toothed rail segments located in selected sections of the rail on its top side.

The travel drive of the above mentioned kind is related to an older proposal of the present Applicant filed as German Patent Application P 24 53 751.7-21. In this older design, the drawing engine ought to be provided with double drives with such axially arranged driving friction wheels and driving toothed wheels which permit the lowest possible structure of the doubled driver For achieving this, the doubled drives must have the driving toothed wheels of the indented drive enabled to be in the travel sections of the rail equipped with indented trajectories retractable down below such indentations within the purpose of making possible that the driving engine (such as for instance a Diesel locomotive or a local shuttling engine), if so be, together with a small number of cars or with unloaded vans train be enabled to be run exclusively by driven friction wheels also along the lengths of the indented track.

Now, this invention has the object of improving this older here alluded to travel drive for a drawing engine (e.g. a suspended tract locomotive or a shuttling local engine) in regard to its exploitation capacity and stability, as well as of achieving a functionally reliable mode op operation thereof. Herein, there need be preserved the lowest possible height of the gearing arrangement and the driving toothed wheels ought to be particularly well and operatively reliably supported by their respective hollow axles carrying these toothed wheels by means of a lifting arrangement contiguous with an elongated hollow shaft, the driving toothed wheels with their indented rims also having to be retractable into protecting chambers installed in the driving friction wheels.

The improved travel drive according to the invention is characterized in that each driving toothed wheel includes a downwardly extending long hollow axle forming a double-action lifting cylinder whereinto there is introduced a fixed piston rod coupled at its bottom end to the gearing unit and having in its lower region control ducts and in its upper region a disc piston. The piston rod itself is axially shiftably guided in a torque transmitting manner in an also elongated downwards extending rotarily drivable hollow shaft that forms at its lower terminal a carrier for a driving gear and at its top terminal the bearing for the driving friction wheel which latter is provided at its upper side with a circular and peripherally embracing protecting chamber shaped to receive the driving toothed wheel together with its indented rim in its retracted position.

The driving toothed wheel is thus bearingly located with its long hollow axle in a considerably stable and secure mode and is axially shiftable in a motorically drivable hollow shaft upon which there are provided in mutual axial spacing a gear wheel and a travel toothed wheel. This kind of construction enables the long hollow axle of the travel driving toothed wheel to be employed as a double-action lifting cylinder. The piston rod of the lifting cylinder lies fixedly and stably supported in the gearing unit and owing thereto is enables an advantegeous positioning of the control ducts for supply and release of the pressurized fluid or of some appropriate medium operatively loading the lifting cylinder.

Such a good central carrying location of the travel driving toothed wheel in the hollow shaft bearing the driving friction wheel makes it possible to use the top side of this driving friction wheel for forming therein a circular protecting chamber sized to receive in its full height the travel driving toothed wheel with its indented rim.

The travel driving toothed wheels are thus, for the entire duration of the exclusive propulsion by action of the driving friction wheels, so deeply immersed in said protecting chambers that none of these rotary toothed wheels tends to obstruct the due function. This immersion of the wheel toothed rim into the deeply sunk protecting chamber, namely a chamber having its bottom positioned deep in the interior of the body of the friction wheel makes it besides possible to establish the rail toothed segments having lateral indentations as high as at, and adjacent, the upper flange plane of the track rail having a double T-cross section. Consequently, the toothed segments of the rail may be simply and stably affixed to the flange of the track rail, the result whereof is the preservation of the intended low constructional height. Also the distance of the raising of the travel driving toothed wheel is correspondigly small. For forming the indented rail segments on the head side of the track rail, use will be made of such indented rail segments that possess on either longitudinal side laterally projecting driving indentations, the raising of the travel toothed wheel occurs at each occasion before reaching in the travel the indented track. The retraction of the wheel correspondingly follows the running out of each indented track.

A well designed embodiment of the travel drive resides according to the invention in a construction where the driving toothed wheel is integral with said hollow axle devised as a lifting cylinder and where an annular piston operating as a resilient closure (lid) of the upper pressure chamber of the lifting cylinder is located upon a piston rod extension arranged over the disc piston on a fixed piston rod and support is provided for said annular piston from above and below by coil springs abutting arresters located in the hollow axle.

This annular piston positioned in this way between such springs ensures that the raising of the driving toothed wheel occurs in an elastic way, so that there is avoided any blocking. Also the upper pressure chamber in the lifting cylinder that is to be loaded with a driving medium may be reduced to the necessary small extent and the volume of the control fluid may be maintained very low.

Another important improvement in the travel drive brought in by the invention is characterized by the fact that there are suspended at the bottom side of the driving toothed wheel at least two interconnected shielding annular bodies telescopically shiftable into one another, which bodies together with the indented rim are immersible into the circular protecting chamber provided in the driving friction wheel and may be elevated to have a horizontal bottom flange provided on the lower annular body up to the border of the circular protecting chamber in the upwards projecting position of the toothed wheel.

These shielding annular bodies suspended on the driving toothed wheel cover the protecting chamber from above to such a degree that, when the driving toothed wheel is in its fully raised position, no dirt can deposit in the protecting chamber. These bodies however do not obstruct in any manner whatsoever the needed deep immersion of the driving toothed wheel with its indented rim into said protecting chamber.

A well devised embodiment of the protecting space is advantegeously built-up in a manner such that the circular protecting chamber having to receive the driving toothed wheel with its indented rim and its shielding annular bodies is formed from an insertable cylinder located in a correspondigly large circular space formed in the wheel body of the driving friction wheel, which cylinder however is in axial length larger than the depth of the circular space in said wheel body. The axially measured width of this body of the driving friction wheel can be thus limited to the smallest possible dimension dependent on the running surface of the friction wheel.

The accompanying drawings illustrate the travel drive according to this invention in two embodiments.

Figure 3:
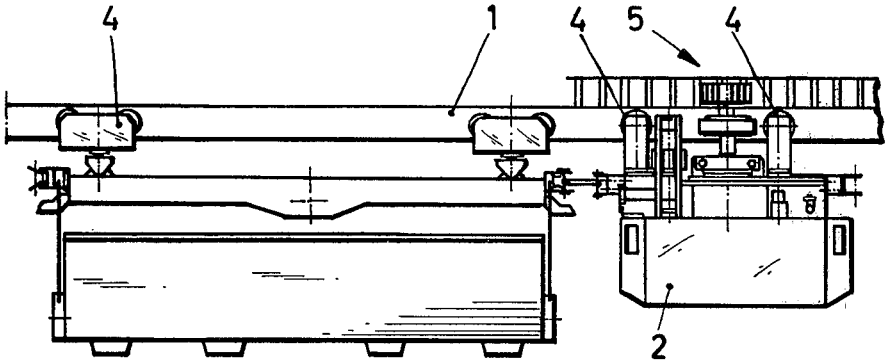
Figure 4:
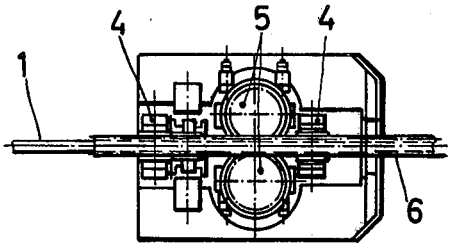
Figure 5:
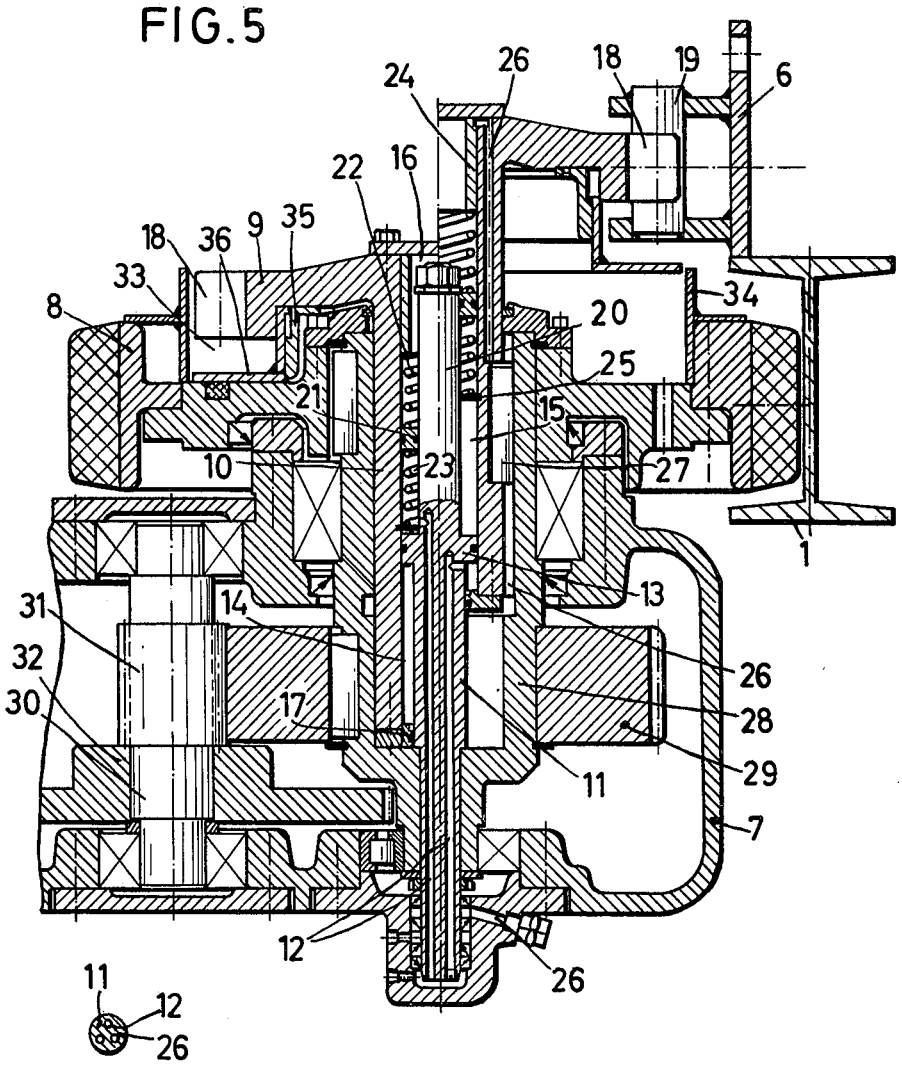
Figure 6:
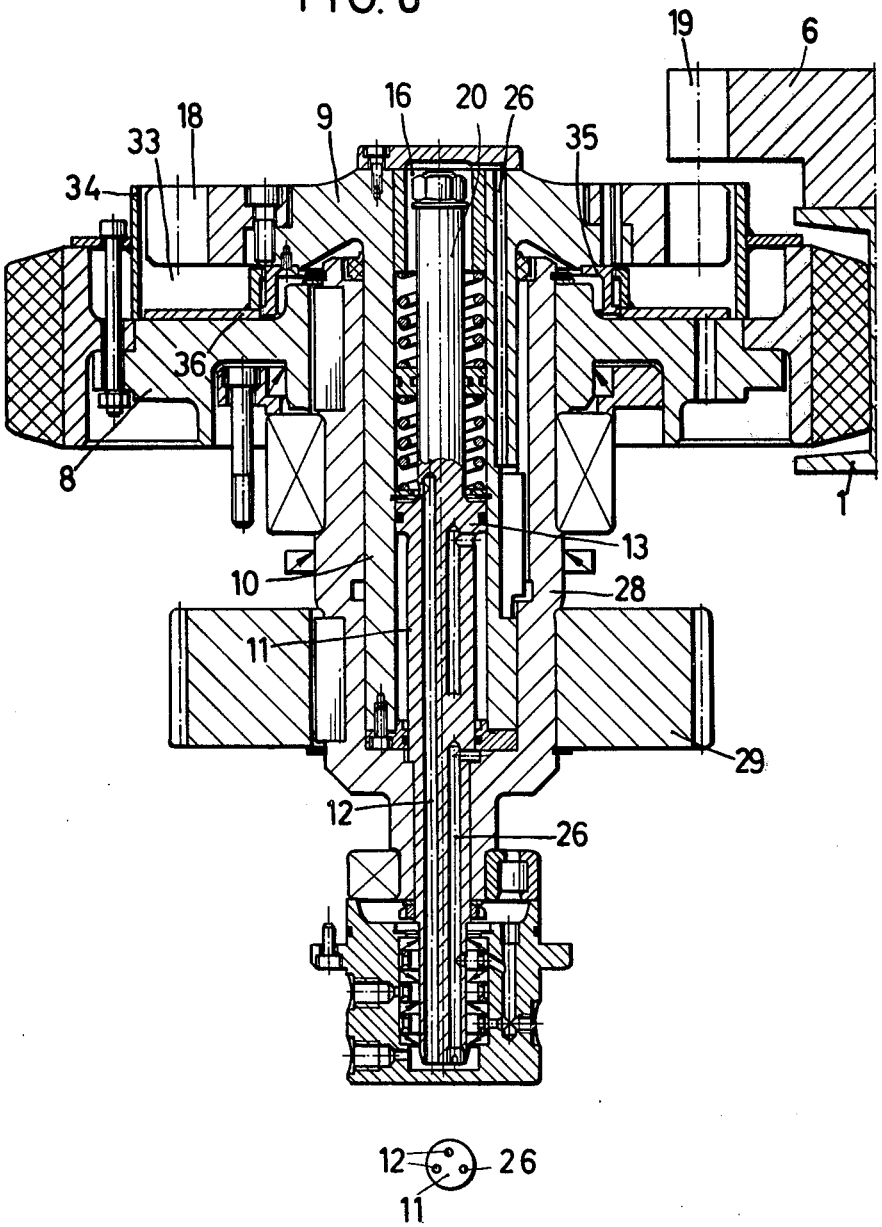

FIG. 3 displays the employment of the travel drivers in connection with a local shuttling engine being the driving engine there utilized;

FIG. 4 is a plan view of the arrangement of the drives on either side of the riding rail;

FIG. 5 illustrates in a vertical cross-sectional view the structure of a double drive in an arrangement lateral to the one rail;

FIG. 6 shows a further exemplary embodiment of the doubled drive in a vertical cross-section.

Figure 1:
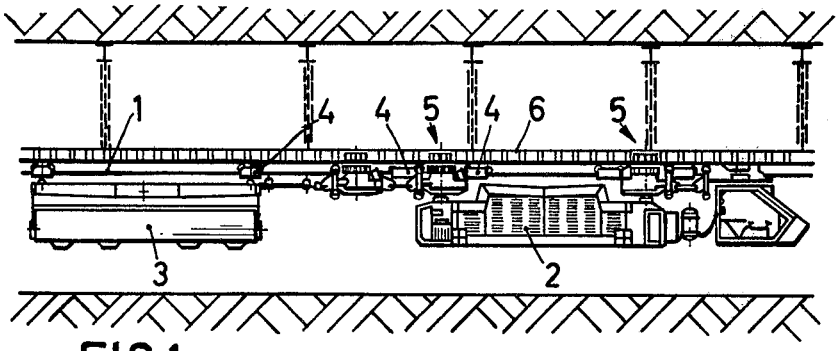
FIG. 1 shows a section of a mine track with a there established one rail suspended rail road.
Figure 2:
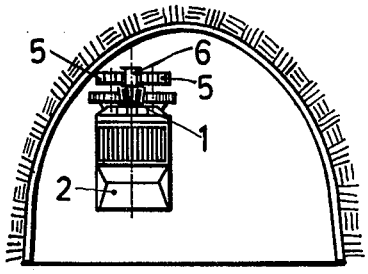
FIG. 2 is a cross-section through FIG. 1.

FIGS. 1 and 2 demonstrate a one-rail suspended railroad track in a mine with the riding rail suspended on the track construction. The pulling engine 2 and the transport cars 3 pulled by the same are suspended by means of the per-se known running members 4 upon the travel rail. FIG. 1 shows a Diesel locomotive being here the utilized drawing engine 2 that has, in addition to the running members, travel drives 5 executed as doubled driving means and consisting in each individual case of a wheel friction drive and a wheel toothed drive. The structure of these travel drives is described herein after in connection with FIGS. 5 and 6.

The top side of the profile of the double-T-configured running rail 1 is equipped at the top flange in sequential sections with indented tracks composed of segments of indented rails 6. Such indented tracks are provided wherever there are climbing or slanting sections engendering difficulties in the travel of such a train along the track and where the friction wheel drives are of a little efficiency. There also may be the question of track sections where the effectiveness of the drive by menas of the friction drives becomes questionable in view of the there deposited grease and dirt sediments. In particular, regarding long trains and heavily loaded transport vehicles, the friction drive in such a mentioned section is insufficient. Contrary thereto, it has appeared that alone riding drawing engines and drawing engines with few unloaded cars may be propelled at a higher speed when driven by the friction drive only. The here provided travel drives are therefore constructed so that the driving toothed wheels of the travel drive arrangement are retractable to such a degree that they can pass underneath the indented rails and, being so adjusted, may be caused to engage and catch the lateral indentations on the indented rail segments in upwardly expelled position in case only of arisen need.

FIG. 3 displays the drawing engine 2 in the form of a local shuttling engine. Here, on either side of the riding rail 1, a doubled driving means is provided as the travel drive 5.

FIG. 4 makes apparent that also in this case the doubled driving means are located in a symmetrical disposition on either side of the travel rail. The drawing engine 2 has located ahead of, and beyond, the driving means 5 running members 4 by means of which the drawing engine is suspended on the travel rail.

A specific constructional configuration of the travel driving means is demonstrated by FIG. 5. The there illustrated doubled drive is located adjacent the travel rail 1. There are provided, as is per-se known, in a symmetrical arrangement on either side of the travel rail identical doubled driving means, the gearing casings whereof my be mutually connected.

Inside the gearing casing 7, or on an engine frame replacing such a gearing casing, there are provided a driving friction wheel 8 and a driving toothed wheel 9. The driving friction wheel 8 lies in a horizontal position at the level of the travel rail and may be compressed against the stem of the travel rail. The driving toothed wheel 9 is contiguous with a downwardly extending long hollow axle 10 forming a double-action lifting cylinder. Into this hollow axle, a piston rod 11 is inserted affixed at its lower terminal to the gearing casing 12 and carrying at its upper terminal a disc piston 13. This disc piston divides the inner space of the hollow axle 10 serving as a lifting cylinder into a lower pressure chamber 14 and an upper pressure chamber 15. Either of these pressure chambers comprises a port from a control duct 12 that interchangeably supplies and withdraws the control fluid. There is a third control duct in the piston rod whose exclusive role it is to vent a further chamber 16 located above the upper chamber 15, being closed frontally of the driving toothed wheel and serving for location of a springing element in the herein after described manner. The lower pressure chamber is closed at its bottom side by an annular lid 17 bound to the lower frontal side of the hollow axle 10.

The pressure charging of the upper chamber 15 of the lifting cylinder propels upwards the hollow axle 10 and the driving toothed wheel 9 fixed at its headside. The stroke is envisaged to be so great that the indented rim 18 be pushed onto the high level of the lateral indentation 19 of the rail indented segment 6. At this instant, the pulling engine moves in the travel direction, so that the driving toothed wheel engagingly runs into the lateral indentation of the indented rail segment 6. After the indented track has been passed along, an appropriate coupling causes pressure loading of the lower pressure chamber 14 in the lifting cyinder. Now, the driving toothed wheel 9 is lowered in effect of a downward movement of its hollow axle 10, so that the toothed wheel arrives spacedly from, and underneath, the indented rail segment 6. In this condition, the driving toothed wheels are run below the next indented rail segments and the respective indented tracks.

In the hollow axle 10 of the driving toothed wheel 9 is a cylindrical piston rod extension 20 arranged over the disc piston 13 on the fixed piston rod 11 and upon this disc piston, an annular piston 21 is positioned being axially movable as a resilient closure (lid) of the upper pressure chamber 15 in the lifting cylinder. This annular piston 21 is supported from above and below by coil springs 22,23. These coil springs abut at their outer ends arresters 24 and 25 arranged inside the hollow axle 10. When the upper pressure chamber 15 is pressure loaded, this annular piston 21 may be shifted against the biasing force of the respective spring when for whatever reason the raising of the driving toothed wheel is impeded or even blocked. Thus, the raising of the driving toothed wheel occurs elastically. As soon as the driving toothed wheel regains a free movability, it progresses to its high position, while the annular piston returns to its normal middle position between the pair of coil springs. Venting of the chamber 16 at the head end of the hollow axle is ensured through the channels 26. Through the same channels, the chamber 16 is vented when the driving toothed wheel 9 is retracted into its low position.

The hollow axle 10 is guided axially shiftably by per se known means 27 (a spring, a nut) with a torque moment transmission in an elongated hollow shaft 28 extending in upward direction. The length of this hollow shaft 28 substantially corresponds to the length of the hollow axle 10 of the driving toothed wheel 9. This hollow shaft 28 forms in its lower section a carrier for an indented gear 29. At the upper end of the hollow shaft 28 is located the driving friction wheel 8 with its wheel body. The driving friction wheel 8 is connected with the hollow shaft 28 in a torque transmitting coupling. In the gearing casing 7, there are affixed to an adjacent shaft 30 the driving gears 31 and 32, which are driven by a not represented driving motor. This gearing transfers the torque moment simultaneously onto the driving friction wheel 8 and the driving toothed wheel 9.

The driving friction wheel 8 is provided with a circular protecting chamber 33 shaped to receive in the retracted position the driving toothed wheel with its indented rim 18. This protecting chamber circumscribes the indented rim of the toothed wheel and has a depth corresponding at least to the thickness of this toothed wheel. Preferably however the depth of this protecting chamber is greater for being capable of housing also the herein after described elements. Thereby at least a portion of this depth of the protecting chamber is formed by a deep cavitation in the top region of the body of the friction wheel. Into the thus formed cavity, an insertable cylinder 34 is introduced which defines the maximum height of the protecting chamber but whose top side does not surpass the flange upper side of the riding rail 1. This insertable cylinder has a T-configured cross-section and includes a horizontally extending shank directed outwardly that serves for fixation of this cylinder to the upper frontal side of the friction wheel.

The bottom side of the driving toothed wheel 9 carries suspended thereupon two shielding annular bodies 35,36 that are telescopically shiftable into one another. These annular bodies 35,36 are immersible together with the indented rim 18 into the circular protecting chamber 33. The inner smaller annular body 35 is affixed at its inwardly extending short horizontal flange to the body of the driving toothed wheel 9. The downwardly directed flange includes an outwardly directed bulge, or a collar upon which it is suspended the outer annular body 36 having an internally extending collar on its inner vertical annulus. This outer annular body 36 comprises a downwards arranged broad horizontal flange reaching to the cylindrical periphery of the insertable cylinder 34. When the driving toothed wheel is raised and/or pushed upwards, the annular body 35 heightens the outer annular body 36 up to the upper border of the insertable cylinder 34. In effect thereof, the protecting chamber 35 is closed on the raising of the driving toothed wheel such that there can not deposit any dirt sediments. This secures that the driving toothed wheel can always be lowered below the lateral indentations of the indented rail segments 6, in which position it is duly protected and avoids any danger of accidents.

The portion of the travel drive reversed from the drive rail may be additionally provided with protective shieldings that are not shown in the drawing since the above described arrangement of the toothed wheel with the shielding annular bodies 35,36 is primarily directed to the prevention of dirt deposits in the protecting chamber. FIG. 5 shows that it could be purposeful to form the indented rim in the form of a collar enlarging in downward direction. This indented rim also can be affixed as a separate annular body to a disc-like wheel body.

The embodiment of the doubled drive displayed in FIG. 6 has a structure substantially corresponding to that shown in FIG. 5. The description given in regard to FIG. 5 is also adaquate in respect to the structure of FIG. 6. In this FIG. 6, the driving toothed wheel comprises a toothed rim formed as a ring having no downwardly enlarging collar. The representation of the piston rod depicts in this case only the control duct 12 leading to the upper pressure chamber 15 in the lifting cylinder and a portion of the air venting and inspiring channel 26 being in constant communication with the venting chamber 16.

I claim:

1. A travel drive for a drawing engine of a single rail suspended railroad used in mines, in which it is provided and located inside a gearing casing on either side of the track rail a friction drive and an indented drive, and where driving friction wheels are positooned horizontally and are compressible against the stem of the track rail and the driving toothed wheels are arranged coaxially with and above the friction wheels, may be limitedly raised and retracted by means of a lifting arrangement, are engageable only when projecting to their highest positions with, and capable of entering, the lateral indentations on the top side (headside) of the track rail, characterized in that:

each one of the driving toothed wheels (9) is contiguous with a downwards extending long hollow axle (10) forming a double-action lifting cylinder, whereinto there is introduced a fixed piston rod (11) coupled at its lower terminal to the gearing casing, comprising in its lower region control ducts (12) and in its upper region a disc portion (13), while itself being torque transmittingly and shiftably located in a rotary drivable hollow shaft (28) being also of elongated configuration and extending downwardly, which shaft is formed in its lower region as a carrier of a driving gear (29) and at its top end as a bearing for the driving friction wheel, which driving friction wheel is provided at its top side with a circular protecting chamber (33) shaped to receive the driving toothed wheel (9) with its indented rim (18) in its rectracted position.

2. The travel drive as defined in claim 1, characterized in that:

the hollow axle (10) of the driving toothed wheel (9) configured as a lifting cylinder has installed therein over a cylindrical extension (20) of the piston rod on the disc piston (13) of a piston rod (11) an annular piston (21) supported inside said hollow axle from above and below by coil springs (22,23) against arresters (24,25) which annular piston is arranged to operate as a resilient closure (lid) of the upper pressure chamber (15) of the lifting cylinder.

3. The travel drive as defined in claim 1, characterized in that:

the driving toothed wheel (9) is provided at its lower side with at least two telescopically shiftable there suspended and coupled annular shielding bodies (35,36) which bodies together with the indented rim (18) are immersible into the circular protecting chamber (33) in the driving friction wheel (8) and which in the highest raised position of the toothed wheel (9) may be raised together with a horizontal bottom flange on the lower annular body (36) up to the upper border of the circular protecting chamber.

4. The travel drive as defined in claim 3, characterized in that:

the circular protecting chamber (33) capable of receiving thereinto the indented rim (18) of the driving toothed wheel (9) and the shielding annular bodies (35,36) is formed from a separate inserted cylinder (34) tightly installed in a correspondingly large circular space in the wheel body of the driving friction wheel (8) which however, so far as its axial length is concerned, is larger than the depth of the circular space in the wheel body.

* * * * *